US007387296B2

(12) United States Patent
Alberti

(10) Patent No.: US 7,387,296 B2
(45) Date of Patent: Jun. 17, 2008

(54) QUICK SET CLAMP DEVICE

(76) Inventor: John L. Alberti, 10906 Walnut Dr., Sunland, CA (US) 91040

( * ) Notice: Subject to any disclaimer, the term of this patent is extended or adjusted under 35 U.S.C. 154(b) by 21 days.

(21) Appl. No.: 11/431,489

(22) Filed: May 10, 2006

(65) Prior Publication Data

US 2007/0262506 A1 Nov. 15, 2007

(51) Int. Cl.
*B25B 1/10* (2006.01)

(52) U.S. Cl. ..... 269/249; 269/143; 269/276; 269/257

(58) Field of Classification Search ..... 269/249, 269/246, 248, 3, 6, 143, 276, 257; 29/276, 29/257

See application file for complete search history.

(56) References Cited

U.S. PATENT DOCUMENTS 1,544,332 A * 6/1925 Mance ..... 73/78
2,602,358 A * 7/1952 Lile ..... 72/409.09
2,636,528 A * 4/1953 Golnick ..... 269/182
5,568,916 A * 10/1996 Gibbons et al. ..... 269/174
5,893,553 A * 4/1999 Pinkous ..... 269/249

* cited by examiner

*Primary Examiner*—Lee D Wilson
(74) *Attorney, Agent, or Firm*—Cherskov & Flaynik

(57) ABSTRACT

A quick set clamp device 10 includes a clamp frame 12, a slide shaft 14 having a longitudinal dimension that cooperates with the clamp frame 12 to removably secure the clamp frame device 10 to an object, a biasing member 16 adjacently disposed to the slide shaft 14, the biasing member 16 having a first end 18 that engages an outer first end portion 20 of the clamp frame 12, a binding member 22 having a first portion that slidably engages the slide shaft 14, a retaining member 26 retractably secured to the outer first end portion 20 of the clamp frame 12, the retaining member 26 engaging a second portion 28 of the binding member 22, a first engagement member 30 secured to a first end 32 of the slide shaft 14, and a second engagement member 34 secured to an inner second end portion 36 of the clamp frame 12.

20 Claims, 7 Drawing Sheets

QUICK SET CLAMP DEVICE

BACKGROUND OF THE INVENTION

1. Field of the Invention

The present invention relates to a quick set clamp device, and more particularly, to a substantially "C" configured quick set clamp device operable by one hand of a user while the user's other hand holds an object or workpiece.

2. Background of the Prior Art

A myriad of clamp sizes and configurations are obtainable for securing together different objects or portions of a workpiece. The more common clamps include C-configured clamps—"C clamps" that are secured to an object via a rotating handle, and slide clamps that include a clamp mechanism and a base or table having a sliding object engagement member that slides toward a stationary object engagement member to ultimately secure an object therebetween.

The C clamps provide sufficient space between opposite engagement members to allow an object to be unobstructedly disposed between the engagement members, thereby providing engagement member access to depressed portions or cavities of the object. One problem with prior art C clamps is the time required to rotate the handle to position the engagement members of the clamp within depressions or cavities of object, then retract the engagement members sufficiently to avoid protuberances corresponding to the depressions or cavities. Another problem with prior art C clamps is that the user has to use two hands to operate the C clamp; one hand to rotate the handle while the other hand holds a frame portion of the C clamp.

Slide clamps provide quick operation when binding the clamp to an object. The user need only pull the trigger, then move the sliding engagement member toward the stationary engagement member. As with the C clamp, the slide clamp requires two hands to operate; one to hold the trigger and handle while the other hand moves the sliding engagement member toward the stationary engagement member. Another problem with prior art slide clamps is that the table or base limits space between the engagement members thereby obstructing placement of the object such that depressions and cavities in the object are not accessible by the engagement members.

A need exists for a clamp device that operates quickly between retracted and object engaging positions; that is capable of being operated by one hand of a user while the user's other hand holds the object; and that is configured to provide sufficient space between opposite engagement members such that an object may be disposed between the opposite engagement members without engaging any portion of the clamp device, thereby providing engagement member access to depressions and cavities in the object. Further, the clamp device should be reliable in operation, relatively inexpensive, light weight and easy to operate.

SUMMARY OF THE INVENTION

It is an objective of the present invention to overcome many of the disadvantages associated with clamping devices having a generally "C" configured frame.

A principle objective of the present invention is to provide a quick set clamp device that quickly secures together portions of an object or workpiece, or that quickly secures the quick set clamp device to an object or workpiece. A feature of the device is that a person with one hand can hold and secure the clamp to the object or workpiece. Another feature of the device is that the person can hold the object or workpiece with their other hand. Yet another feature of the device is a plurality of apertures through a substantially "C" configured clamp frame of the device to reduce the weight of the clamp frame while providing a grasping portion for a person's hand thereby facilitating a one handed operation of the clamp device. An advantage of the device is that the person can quickly secure, then quickly remove the device from the object or workpiece. Another advantage of the device is that the C configuration disposes clamp engagement members oppositely while providing sufficient space therebetween such that the engagement members can be disposed within a cavity of an object such as a violin.

Another objective of the present invention is to provide a quick set clamp device that allows multiple devices to be positioned adjacently or side-by-side. A feature of the device is a frame with planar side walls which are separated a distance equal to or less than the diameter of object engagement portions of the clamp device. An advantage of the device is that pressure can be applied uniformly across the surfaces of opposing portions of the object or workpiece thereby preventing surface discontinuity between the opposing portions.

Yet another objective of the present invention is to provide a quick clamp device that operates by sliding rather than rotating members when securing or removing the device from an object or workpiece. A feature of the device is a slide shaft that is urged, via a person's thumb, from a retracted to a binding position relative to a clamp frame. An advantage of the device is that the person can hold the clamp frame between the palm and fingers while pushing upon a knob portion of the slide shaft with their thumb to force a first engagement member, on the opposing end of the slide shaft, into forcible engagement with the object or workpiece until the object or workpiece forcibly engages a second engagement member secured to an opposing portion of the clamp frame.

Still another objective of the present invention is to provide a quick clamp device that substantially maintains the position of the slide shaft relative to the frame after the first and second engagement members engage the object or workpiece. A feature of the device is a binding member having a first portion that slidably engages the slide shaft, and having a second portion that engages a retaining member. Another feature is a biasing member that cooperates with the binding member and retaining member to skew or angle the position of the binding member relative to the slide shaft. An advantage of the device is that the binding member promotes unrestricted movement of the slide shaft through an aperture in the binding member in a direction toward an object until the object or workpiece is secured between the first and second engagement members. Another advantage of the device is the binding member prevents retracting the slide shaft through the aperture until a person manually urges the binding member to a position that releases the slide shaft thereby allowing the object or workpiece to be separated from the clamp device.

Another objective of the present invention is to provide a quick clamp device that allows the force imparted by the engagement members upon the object or workpiece to be increased after initially securing the clamp device to the object or workpiece via the slide shaft. A feature of the device is a retaining member that rotationally inserts into a threaded aperture in an outer first end portion of the clamp frame while the retaining member engages the binding member. An advantage of the device is that by inserting the retaining member into the clamp frame, the grasp of the binding member upon the slide shaft increases, while at the same time increasing the force applied from the slide shaft to the first engagement member, thereby increasing the grasp of the first and second engagement members upon the object or workpiece.

Another objective of the present invention is to provide pads that engage and secure an object or workpiece to the clamp device. A feature of the device is a swivel and "O" ring combination that cooperate with a pad to retain a selected pad position after the pad is moved by a user of the clamp device or by the urging of the object or workpiece. An advantage of the device is that after removing an object or workpiece, a replacement object or workpiece having substantially the same configuration and dimensions as the removed object or workpiece is quickly positioned to engage top walls of the pads thereby reducing the time required to secure the replacement object or workpiece to the clamp device.

Briefly, the invention provides a clamp device comprising a clamp frame configured and dimensioned to removably receive an object; a slide shaft having a longitudinal dimension that cooperates with said clamp frame to removably secure together portions of the object, said slide shaft being disposed such that a user is capable of urging said slide shaft toward said clamp frame via a thumb portion of the user's hand while at least one finger of the same hand supports said clamp frame; a biasing member disposed upon said slide shaft, said biasing member having a first end that engages an outer first end portion of said clamp frame; a binding member having a first portion that slidably engages said slide shaft; a retaining member retractably secured to said outer first end portion of said clamp frame, said retaining member engaging a second portion of said binding member; and a first engagement member secured to a first end of said slide shaft, and a second engagement member secured to an inner second end portion of said clamp frame, whereby said slide shaft and said first engagement member secured thereto are urged toward said second engagement member until securing an object between said first and second engagement members, whereupon, said retaining member is inserted into said clamp frame thereby urging said retaining member, binding member and biasing member to cooperate to move the position of said slide shaft relative to said clamp frame to facilitate forceful engagement between said first engagement member and a first portion of the object, and to facilitate forceful engagement between said second engagement member and a second portion of the object.

The invention further provides a clamp comprising a substantially C configured clamp frame; a slide shaft having a longitudinal dimension that cooperates with said clamp frame to removably secure together portions of the object, said slide shaft being disposed such that a user is able to urge said slide shaft toward said clamp frame while the user supports said clamp frame; a biasing member adjacently disposed to said slide shaft, said biasing member having a first end that engages an outer first end portion of said clamp frame; a binding member having a first portion that slidably engages said slide shaft; a retaining member disposed to engage a second portion of said binding member; and a first engagement member secured to a first end of said slide shaft, and a second engagement member secured to an inner second end portion of said clamp frame, whereby said slide shaft and said first engagement member secured thereto are urged toward said second engagement member until securing an object between said first and second engagement members, whereupon, said retaining member, binding member and biasing member cooperate to move the position of said slide shaft relative to said clamp frame to facilitate forceful engagement between said first engagement member and a first portion of the object, and to facilitate forceful engagement between said second engagement member and a second portion of the object.

The invention also provides a method for clamping together portions of a workpiece, said method comprising the steps of providing a substantially C configured clamp frame; providing a slide shaft dimensioned to cooperate with said clamp frame to secure together portions of a workpiece; disposing an engagement member upon an engagement portion of said clamp frame and disposing an engagement member upon an end of said slide shaft; sliding said slide shaft to urge said engagement members into engagement with the portions of the workpiece; binding said slide shaft after said engagement members engage the portions of the workpiece; moving said slide shaft, via a retaining member, to increase the securing force imparted by said engagement members upon the workpiece; and maintaining said securing force imparted by said engagement members upon the portions of the workpiece until moving a binding member and/or said retaining member to release said slide shaft, whereupon, said engagement members are separated from the portions of the workpiece.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DESCRIPTION OF THE PREFERRED EMBODIMENT

Figure 1:
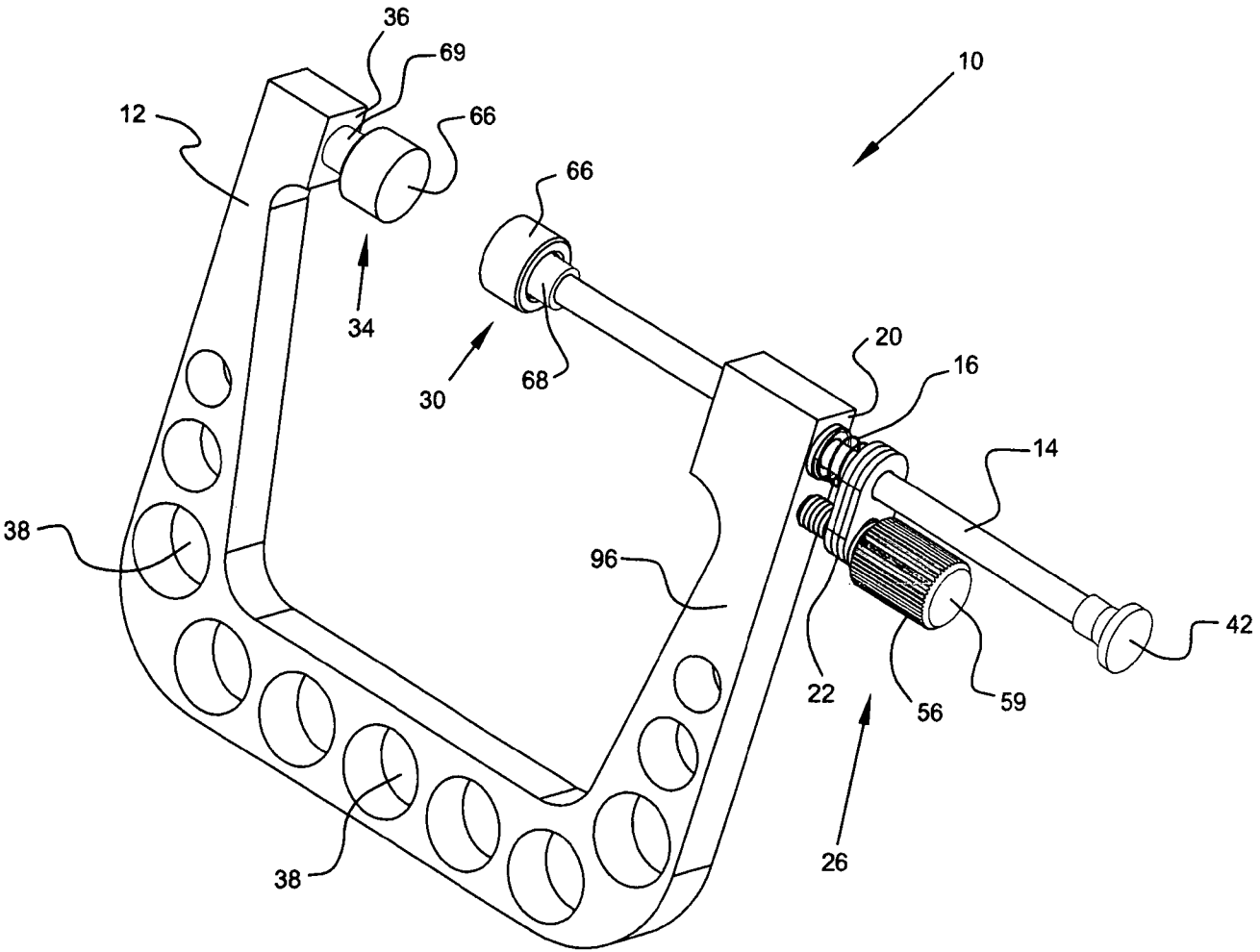
FIG. 1 is a perspective view of a quick set clamp device in accordance with the present invention.
Figure 2:
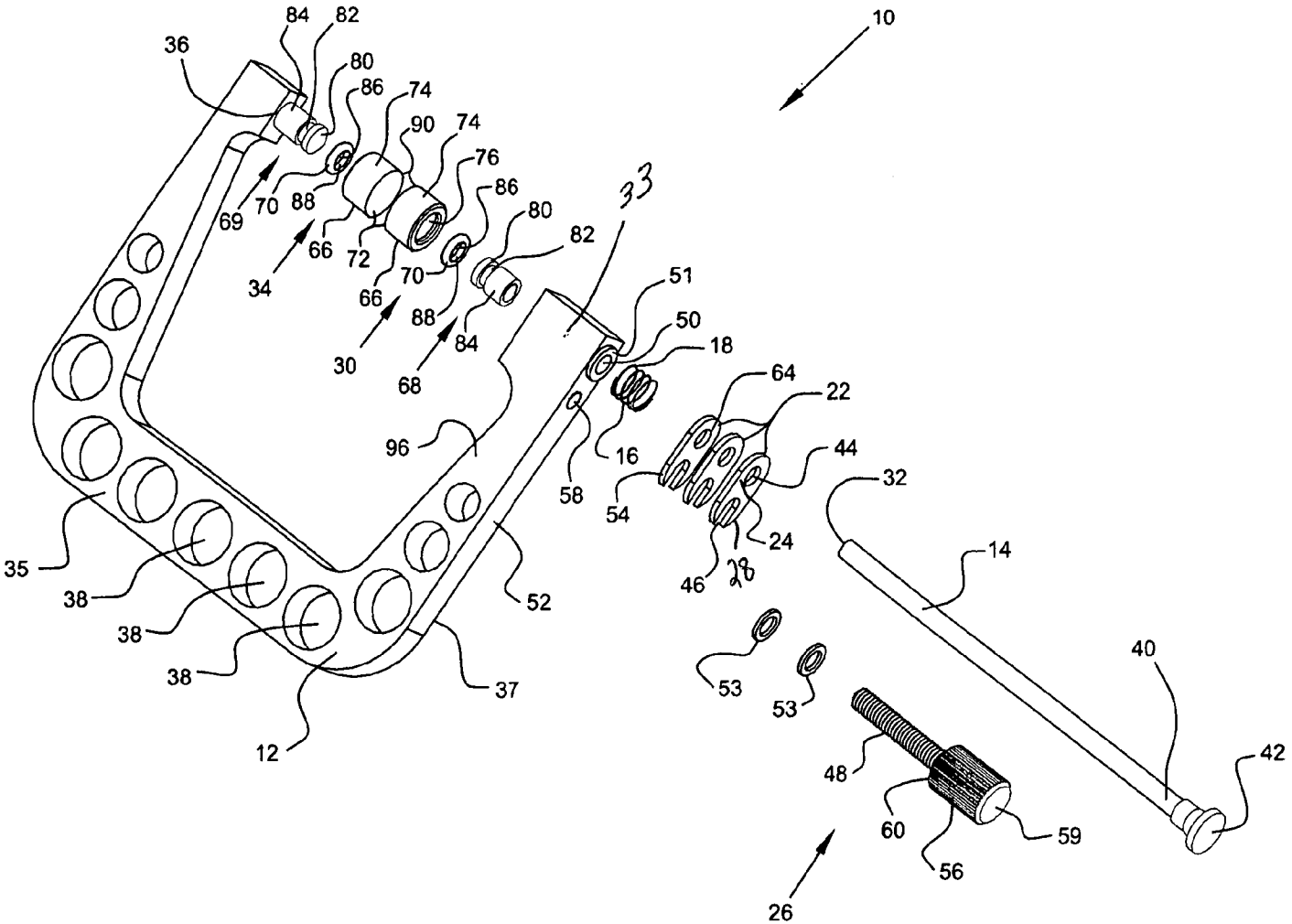
FIG. 2 is an exploded perspective view of the quick set clamp device of FIG. 1.
Figure 3:
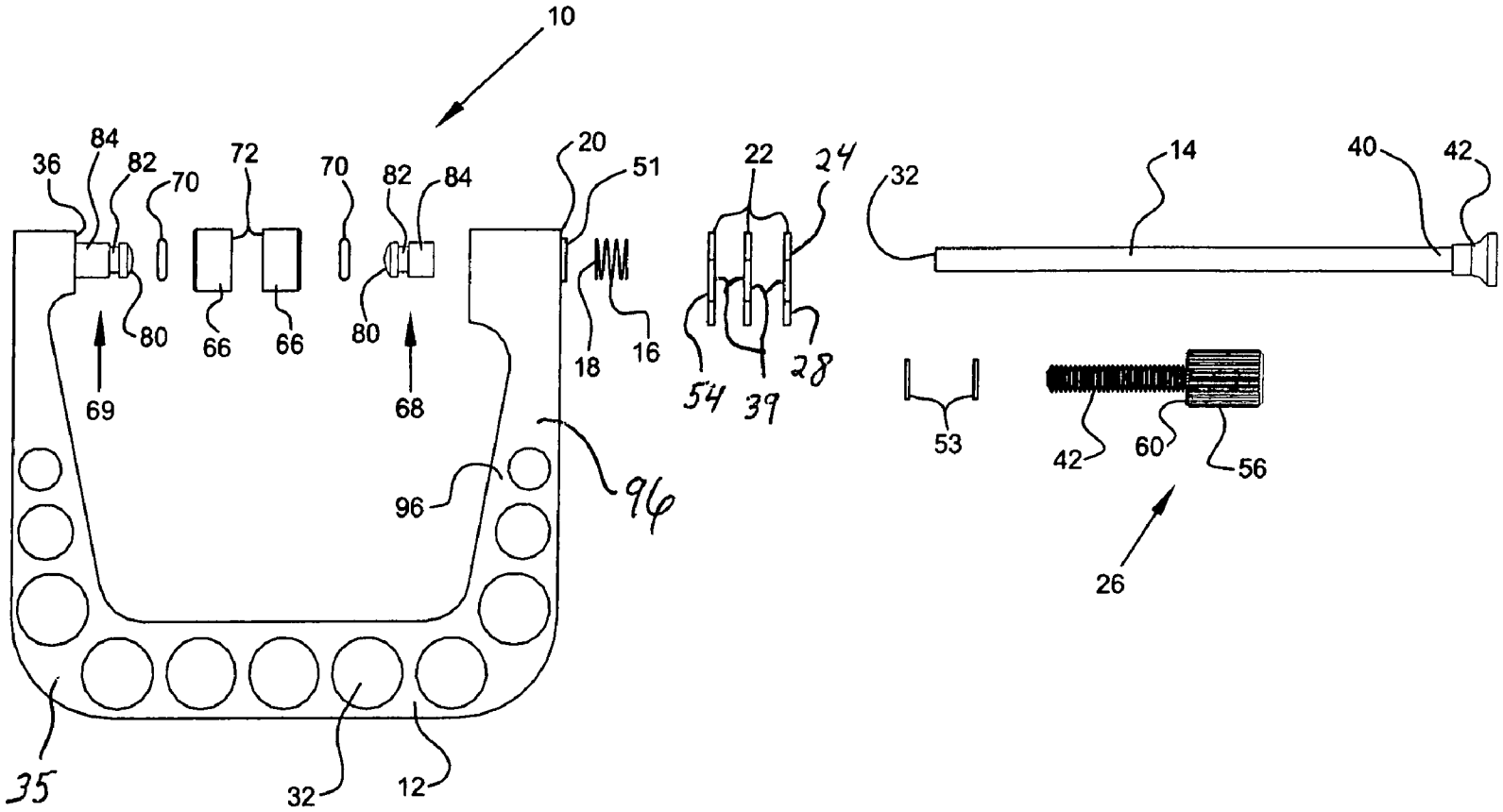
FIG. 3 is an exploded front view of the quick set clamp device of FIG. 2.
Figure 4:
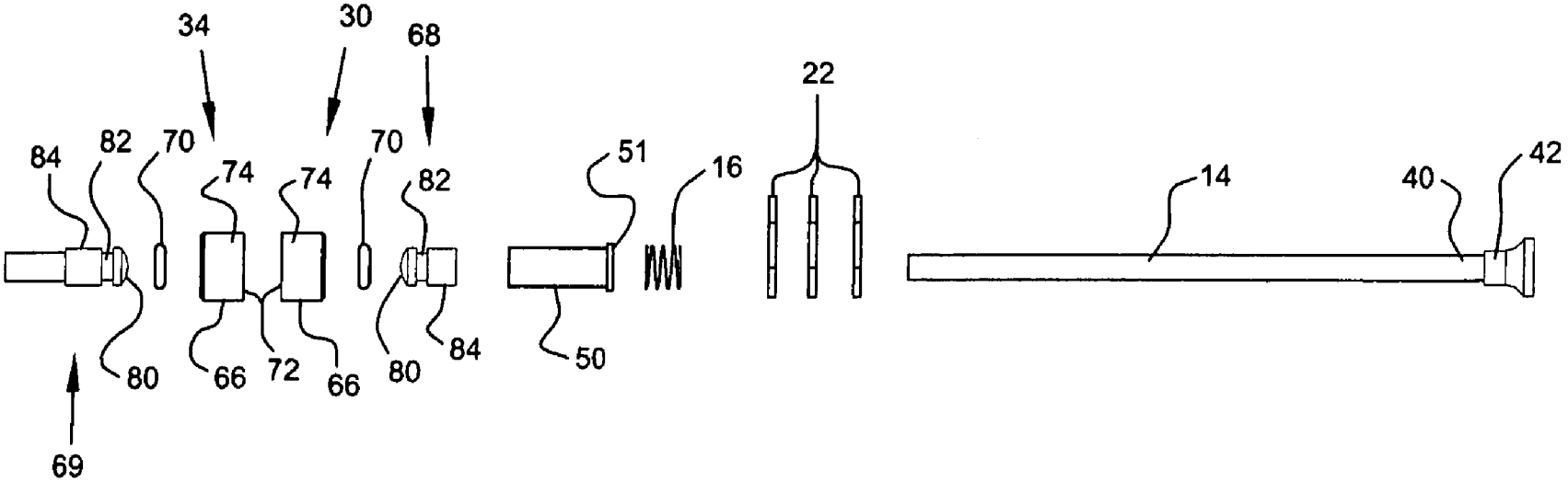
FIG. 4 is an exploded top view of the quick set clamp device of FIG. 3, but with the clamp frame and retaining member removed, and binding plates rotated ninety degrees.
Figure 5:
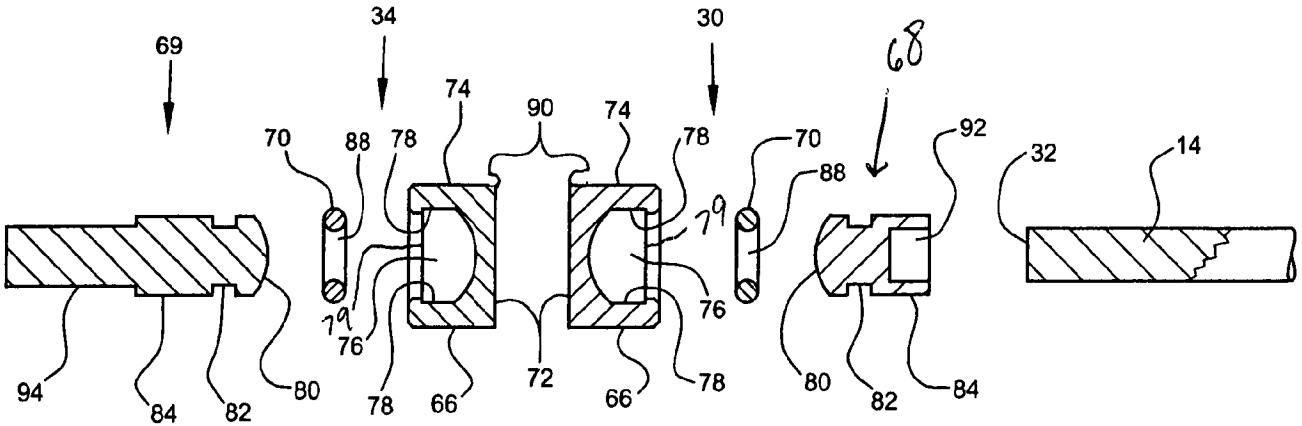
FIG. 5 is an exploded sectional view of the first and second engagement members of FIG. 4.
Figure 6:
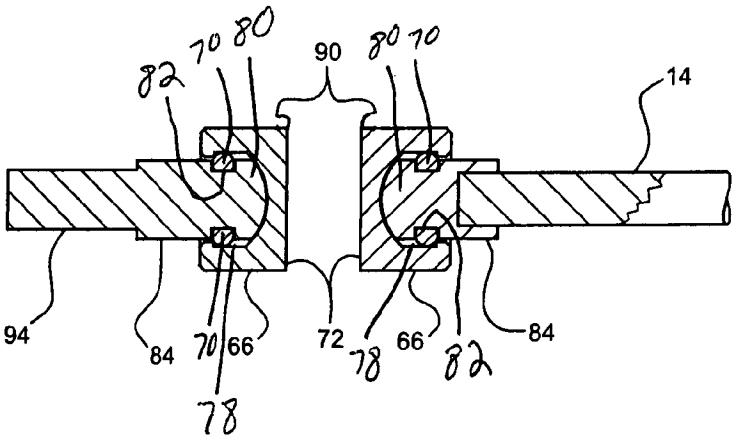
FIG. 6 is an assembled sectional view of the first and second engagement members of FIG. 5.
Figure 7:
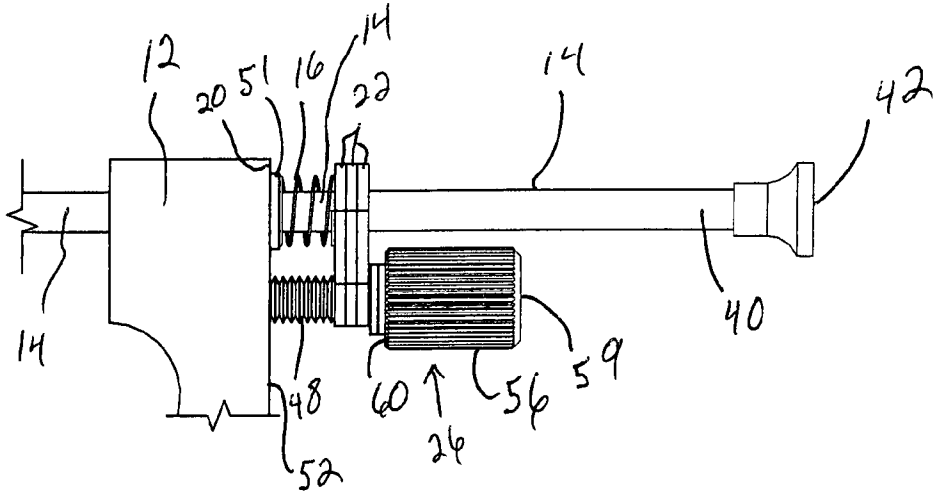
FIG. 7 is a front elevation of an outer first end portion of a clamp frame of the quick set clamp device of FIG. 1 with a spring, binding plates and retaining member in a non-biased position in accordance with the present invention.
Figure 8:
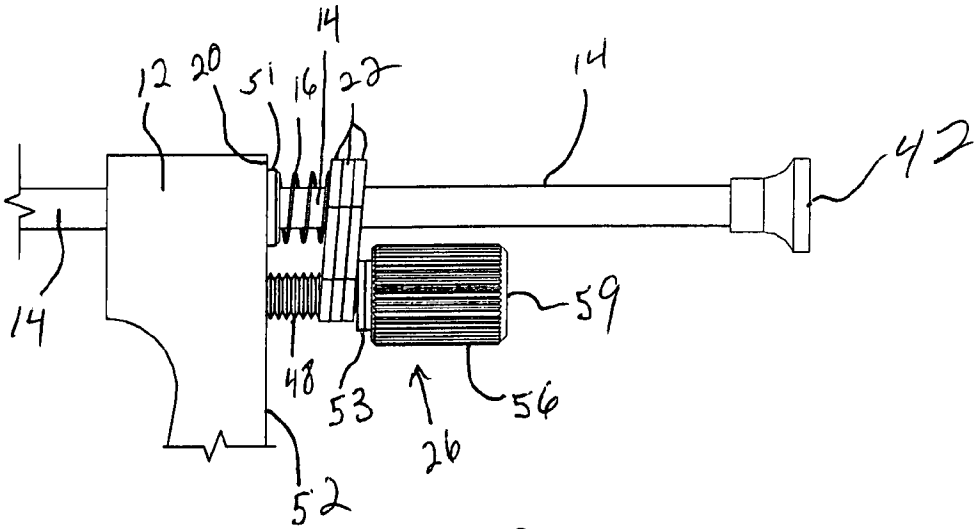
FIG. 8 depicts the same elements of FIG. 7 except that the spring, binding plates and retaining member are in a biased position with the binding plates being "skewed" or sightly angled in accordance with the present invention.
Figure 9:
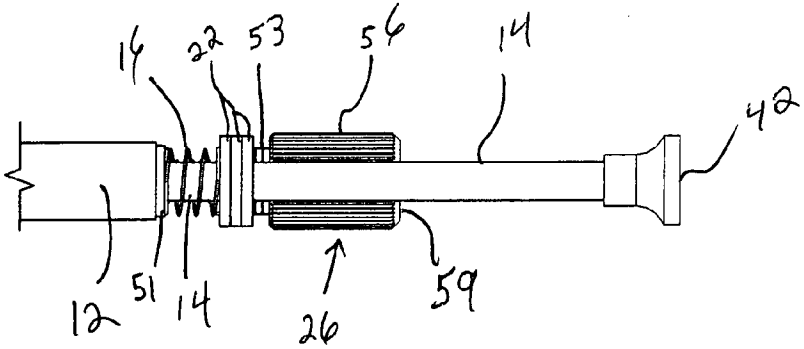
FIG. 9 is a top elevation view of FIG. 7.
Figure 10:
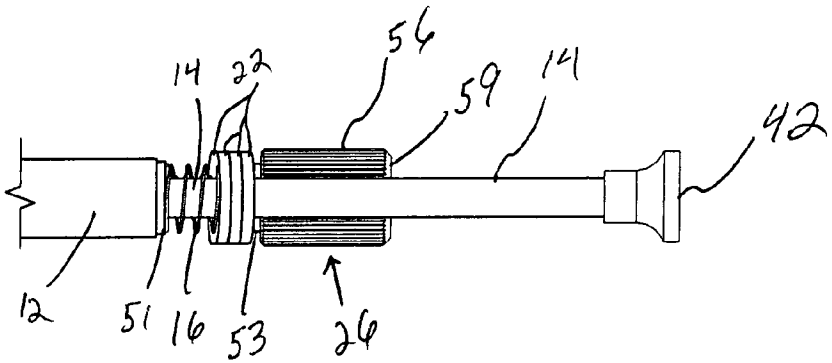
FIG. 10 is a top elevation view of FIG. 8.

Referring now to the drawings, a quick set clamp device operable by one hand of a user in accordance with the present invention is denoted as numeral 10. The clamp device 10 includes a clamp frame 12 configured and dimensioned to removably receive a myriad of objects including but not limited to wood products, metal items and portions of musical instruments; a slide shaft 14 having a longitudinal dimension that cooperates with the clamp frame 12 to removably secure the clamp device 10 to an object; a biasing member 16 adjacently disposed to the slide shaft 14, the biasing member 16 having a first end 18 that engages an outer first end portion 20 of the clamp frame 12; a binding member 22 having a first portion 24 that slidably engages the slide shaft 14; a retaining member 26 removably secured to the outer first end portion 20 of the clamp frame 12, the retaining member 26 engaging a second portion 28 of the binding member 22; a first engagement member 30 secured to a first end 32 of the slide shaft 14; and a second engagement member 34 secured to an inner second end portion 36 of the clamp frame 12.

The clamp device 10 is assembled for operation by inserting the first end 32 of the slide shaft 14 through the binding member 22, biasing member 16 and first end 33 of the clamp frame 12, whereupon, the first end 32 is secured to the first engagement member 30. The clamp device 10 is further assembled for operation by rotationally inserting the retaining member 26 through the binding member 22 and into a cooperating threaded recess 58 in the outer first end portion 20 of the frame, the retaining member 26 being inserted into the recess 58 a relatively small distance. Besides being easily assembled, the clamp device 10 may be quickly disassembled for maintenance and/or replacing damaged portions. The slide shaft 14 and the first engagement member 30 secured thereto are slidably rather than rotationally urged toward the second engagement member 34 until the first and second engagement members 30 and 34 engage an object, whereupon, the binding member 22 "bites" or grasps the surface of the slide shaft to maintain the position of first engagement member 30 relative to the object. The retaining member 26 is then rotationally inserted further into the threaded recess 58 to ultimately increase the compression or grasping force imparted upon the object by the first engagement member 30. Thus, the slide shaft 14 is "locked" in place to maintain forceful engagement between the first engagement member 30 and a first portion of the object, and to maintain forceful engagement between the second engagement member 34 and a second portion of the object.

The clamp frame 12 is fabricated from a light weight, rigid, non-deformable material and includes a substantially "C" configuration that facilitates the securing of an object to the device 10 while a user holds the object with one hand and urges the slide shaft 14 toward the object to ultimately secure the object between the first and second engagement members 30 and 34. The clamp frame 12 further includes a plurality of apertures 38 for reducing the weight of the clamp frame 12 to correspondingly reduce the risk of skewing or damaging fragile objects. The lighter frame 12 also promotes a one-handed operation of the device 10 by the user to reduce the time required to secure the object to the device 10, or to secure selected portions of the object together by forcefully engaging the damaged portions with respective first and second engagement members 30 and 34 of the device 10.

The configuration of the clamp frame 12 allows a myriad of clamps 10 varying in size to be fabricated to removably receive objects varying in size and configuration. Further, the relatively small lateral dimension separating planar top and bottom walls 35 and 37 of the "thin" clamp frame 12 allows a plurality of frames 12 to be adjacently secured ("side-by-side") to the object thereby uniformly applying pressure across damaged portions of the object to ultimately dispose the damaged portions at the positions occupied before the object was damaged. For example, when repairing fragile portions of a violin, a relatively "light" weight clamp device 10 reduces the risk of the device 10 damaging the violin. When using a series of thin, light weight devices 10 adjacently disposed to uniformly apply pressure across opposing surfaces of joined damaged portions of the violin, the risk of distorting the position or damaging the surfaces is substantially reduced. Large clamp devices 10 having large clamp frames 12 require apertures 38 with larger diameters to limit the weight of the clamp 10, thereby allowing large clamps 10 to be used with relatively large fragile objects.

The slide shaft 14 is fabricated from a solid cylinder of rigid, durable material, preferably stainless steel, and includes the first end 32 having the first engagement member 30 secured thereto, and a second end 40 having means, including an enlarged "knob" 42 configuration, for manually disposing, via a user's thumb, the slide shaft 14 relative to the clamp frame 12. The longitudinal dimension of the slide shaft 14 may be selected to facilitate a one handed operation of the device 10. More specifically, the clamp frame 12 and slide shaft 14 are cooperatively dimensioned to allow a user to grasp a hand portion 96 of the frame 12 between fingers and the palm of the hand of the user, and to allow the user's thumb to forcibly push upon the knob 42 to urge the slide shaft 14 through the outer first end portion 20 of the frame 12 until the first and second engagement members 30 and 34 forcibly engage respective first and second portions of the object to be secured thereby "pinching" the object between top planar walls 72 of pad portions 66 of the engagement members 30 and 34. The one handed operation of the frame 12 and slide shaft 14 allow the user the hold the object with one hand and operate the device 10 with the other hand.

The biasing member 16 includes a myriad of resilient, deformable devices, the preferred device being a spring fabricated from stainless steel and configured to be annularly disposed about the slide shaft 14. The spring 16 is compressed via the binding member 22, when rotationally inserting the retaining member 26 into the threaded recess 58 in the clamp frame 12, the retaining member 26 ultimately urging the binding member 22 and the spring 16 toward the outer first end portion 20 of the frame 12.

The binding member 22 includes at least one or more, depending upon the application of the device 10, relatively "thin" metal, oval or eccentric shaped binding plates 22 that are congruently configured with planar surfaces 39 to promote the "stacking" of the plates 22 when assembling the clamp 10. The plates are fabricated from a metal "softer" than the metal forming the slide shaft 14, thereby preventing the "shaving" or galling of the cylindrical surface of the slide shaft 14 by the plates 22 as the slide shaft 14 is urged through the plates 22 and clamp frame 12 by tightening the retaining member 26. The first portions 24 of the binding plates 22 include apertures 44 that are axially aligned to slidably receive the slide shaft 14 therethrough. The slide shaft 14 ultimately inserts through the apertures 44, spring 16 and a guide bushing 50 inserted through an aperture in the outer first end portion 20 of the frame 12. The bushing 50 includes an enlarged end portion 51 that engages a planar outer wall 52 of the outer first end portion 20 of the clamp frame 12. The bushing 50 prevents the shaft 14 from eroding the inner cylindrical wall of the aperture through the first end portion 20 as the slide shaft 14 inserts into the clamp frame 12 to forcibly urge the first engagement member 30 to engage the object disposed between the engagement members 30 and 34.

The second portions 28 of the binding plates 22 include recesses 46 that are congruently aligned to removably receive a threaded first end portion 48 of the retaining member 26. The threaded first end portion 48 is sufficiently long to ultimately insert through two washers 53 and the recesses 46, and be rotationally inserted into the treaded recess 58 in an outer wall 52 of the first end portion 20. The threaded first end portion 48 is rotationally inserted into the threaded recess until an inner end 60 of a knurled second end portion 56 of the retaining member 26 engages and urges the second portions 28 of the binding plates 22 toward the outer wall 52 to a position that results in the compression of the spring 16 via the first portions 24 of the binding plates 22. The washers 53 prevent engagement between the inner end 60 of the second end portion 56 and the corresponding planar surface 39 of the adjacent binding plate 22 thereby reducing friction and erosion of the upon the surface 39 of the adjacent binding plate 22 and the inner end 60 of the second end portion 56. The knurled second end portion 56 of the retaining member 26 promotes a "feel" by the user so that the user does not over torque the retaining member 26 and damage a fragile object secured to the clamp device 10. Further, the knurled second end portion 56 includes a recess 59 with a drive screw (not depicted) therein that cooperates with an extension tool to allow the user to distally insert or retract the retaining member 26 from the aperture 58, thereby promoting the manual rotation of the knurled second end portion 56 when multiple clamp devices 10 are adjacently disposed upon the object. Although, the depicted retaining member 26 is the preferred configuration to position the binding plates 22, a myriad of alternative configurations and devices may used, including but not limited to levers, cams, clamps and locking type mechanisms.

The forces generated by the retaining member 26 and the spring 16 cooperate to skew the position of the oval shaped binding plates 22 such that the planar surfaces 39 form acute angles with the axes of the slide shaft 14 and retaining member 26; instead of the substantially right angles that are formed between the plate 22 surfaces and the slide shaft 14 longitudinal axis before the retaining member 26 engages the plates 22. The skewed or "tilted" position of the plates 22 results in the "grasping" of the cylindrical wall of the slide shaft 14 by edges 64 formed by the plate apertures 44, which the slide shaft 14 inserts through. The diameters of the slide shaft 14 and apertures 44 cooperate to sufficiently skew the plates 22 relative to the slide shaft 14 to initiate sufficient grasping force of the plates 22 upon the slide shaft 14 to facilitate the securing of the object between the first and second engagement members 30 and 34.

The secured object is quickly separated from the clamp device 10 by manually pushing the first portion 24 of the binding plates 22 toward the clamp frame 12 until the plates 22 release the slide shaft 14, then manually retracting the slide shaft 14 from the clamp frame 12 a distance that sufficiently separates the first engagement member 30 from the object. In the event that the retaining member 26 has been excessively tightened to the clamp frame 12 such that the first portion 24 cannot be pushed toward the frame 12, the second end portion 56 of the retaining member 26 must be rotated in a retraction direction until the plate first portions 24 can be manually pushed toward the frame 12. Pushing the first portion 24 of the plates 22, compresses the spring 16 and removes the grasp of the plate aperture edges 64 upon the cylindrical wall of the slide shaft 14, thereby allowing the slide shaft 14 to be manually retracted through the clamp frame 12 to allow the object to be removed from the clamp device 10.

The first and second engagement members 30 and 34 include pads 66 for engaging predetermined portions of the object, first and second pad swivels 68 and 69 that promote a pivoting movement of the pads 66 upon the pad swivels 68 and 69, and "O" rings 70 for pivotally securing the pads 66 to the pad swivels 68 and 69 via edge portion 79. The pads 66 are fabricated from light weight metal, preferably anodized or coated aluminum to which glue cannot adhere, and include a top planar wall 72, a cylindrical side wall 74 and a cavity 76 having a recess portion 78 that forms the edge portion 79. The recess portion 78 has a diameter relatively larger than the diameter of a first portion 80 of the pad swivels 68 and 69. The recess portion 78 diameter is relatively smaller than the outer diameter of the O rings 70. The inner diameter of the edge portion 79 is relatively smaller than the diameter of the recess portion 78. The recess portion 78 and edge portion 79 cooperate to retain an O ring 70 within the cavity 76.

The first and second pad swivels 68 and 69 are fabricated from a rigid, non-deformable material, and include a second portion 82 having a diameter relatively smaller than the diameter of the first portion 80, and a third portion 84 having a diameter relatively larger than the diameter of the second portion 82. The first, second and third portion 80, 82 and 84 diameters cooperate to dispose and secure the O ring 70 upon the second portion 82 via forcibly inserting the first portion 80 through an aperture 86 of the O ring 70 until an inner portion 88 of the O ring 70 engages the second portions 82 of the pad swivels 68 and 69. The first pad swivel 68 includes an aperture 92 sized and configured to snugly receive the first end 32 of the slide shaft 14, thereby securing the first pad swivel 68 upon the slide shaft 14. The second pad swivel 69 includes an insertion end portion 94 sized and configured to snugly insert into a cooperating aperture (not depicted) in the inner second end portion 36 of the clamp frame 12, thereby securing the second pad swivel 69 to the clamp frame 12.

The O rings 70 are configured and dimensioned to promote pad retention and pivotal movement between the pads 66 and the pad swivels 68 and 69. The O rings 70 are fabricated from rubber or similar deformable material that cooperate with the configuration and dimensions of the O rings to provide rigidity to the pad swivels 68 and 69 when inserted with the O rings into the cavities 76 in the pads 66. The relative size of an O ring compressed between the recess portion 78, and first, second and third portions 80, 82, and 84 of the pad retainers 68 and 69, will influence the retaining force exerted upon the pads 66, the retaining force being sufficiently large to oppose unwanted movement of the pads upon the pad retainers 68 and 69, while being sufficiently small to allow a person operating the clamp 10, to manually move the pads 66 to preselected positions. A pad 66 position will be maintained until the secured object or a person urges the pad 66 to a different position, thereby preventing the pads 66 from skewing and obstructing the engagement of the object while positioning the clamp device 10 adjacent to the object. Further, the pads 66, pad swivels 68 and O rings 70 of the first and second engagement members 30 and 34 cooperate to interchange pads 66 of varying dimensions to promote the adaptation of the clamp 10 for objects varying in type, size or configuration.

In operation, a clamp device 10 is sized to allow portions of an object with a symmetrical or asymmetrical configuration to be disposed between opposing pads 66 of first and second engagement members 30 and 34. The pads 66 are spaced apart a distance that allows the object to be disposed between the pads 66. The binding plates are slightly skewed upon the slide shaft 14 due to the retaining member 26 being rotationally inserted into the frame 12 after the threaded first end 48 of the retaining member 26 is inserted through the recesses 46 in the plates 22. More specifically, the retaining member 26, while engaging the second portion 28 of the plates 22, is rotationally inserted into a threaded recess 58 in the outer wall 52 of the frame 12 a distance that compresses the spring 16, thereby forcing the first portion 24 of the plates 22 away from the outer wall 52, while the inner end 60 of the retaining member 26 forces the second portion 28 of the plates 22 toward the outer wall 52.

A person then secures the portions together by holding the object between the engagement members 30 and 34 with one hand, grasping the hand portion 96 of the clamp frame 12 between fingers and palm of the other hand; then via the thumb of the hand holding the frame 12, pushes the knob 42 and correspondingly urges the slide shaft 14 through the binding plates 22, spring 16 and outer first end portion 20 of the clamp frame 12, until the object is secured between opposing pads 66 of the first and second engagement member 30 and 34. The aperture edges 64 of the plates 22 grasp or "bite" the cylindrical wall of the slide shaft 14 thereby maintaining the position of the slide shaft 14 relative to the clamp frame 12, and correspondingly maintaining the position of the first and second engagement members 30 and 34 relative to the object. The grasp of the plates 22 upon the slide shaft 14 and the engagement force exerted upon the object by the first and second engagement members 30 and 34, may be increased by further inserting the retaining member 26, via the manual rotation of the second end portion 56, into the threaded recess 58 in the outer first end portion 20 of the clamp frame 12.

The object will remain secured between the first and second engagement members 30 and 34 until the retaining member 26 is retracted or the binding plates 22 are released from grasping the slide shaft 14. The slide shaft 14 is then easily retracted from the clamp frame 12 a distance that promotes separation of the clamp device 10 from the object. It may be necessary to retract the retaining member 26 from the clamp frame 12 a small distance before manually manipulating the plates 22, if a relatively large force is imparted to the engagement members 30 and 34 via the slide shaft 14.

In the event the object is relatively small, damage may occur to the object by using excessive manually force when rotationally securing the retaining member 26 to the clamp frame 12. Applying excessive force to the retaining member 26 correspondingly applies excessive force to the slide shaft 14, which transfers the force to the pads 66 and ultimately to the object resulting in the surface of the object being deformed and/or marred. To avoid this scenario, the tightening of the retaining member 26 is not utilized, except to initially bias the binding plates 22 via the spring 16. Instead, the slide shaft 14 is operated as described above to secure the pads 66 to the object; that is, the person urges the slide shaft 14 and pads 66 into engagement with the object via the knob 42. The user then simply releases the knob 42. The configurations of the binding plates 22 and the first end portion 48 of the retaining member 26, together with the small retaining forces required for the engagement members 30 and 34 to grasp and secure the object to the clamp frame 12, will cause the binding plates 22 position to skew relative to the longitudinal axis of the slide shaft 14. The skewed binding plates 22 result in the edges of the apertures 44 in the binding plates 22 grasping the slide shaft 14 with sufficient force to maintain engagement between the engagement member pads 66 and the object. The pads 66 will remain engaged with the object until a person retracts the retaining member 26 and/or moves the binding plates 22 to a position that releases the grasp of the plates 22 upon the slide shaft 14. A release position for the binding plates 22 is substantially the perpendicular orientation of the planar sides of the binding plates 22 with the longitudinal axis of the slide shaft 14.

Although one embodiment of the present invention is to provide a quick set clamp device 10 that is operable by one hand of a user, another embodiment of the present invention includes a relatively large, "heavy-duty" clamp device requiring two hands or more than one person to position and operate the heavy-duty clamp to secure a workpiece or one or more objects. The heavy-duty clamp would vary from the above one hand operated clamp device 10 by being substantially larger in size and with a heavier clamp frame 12.

While this invention has been described with reference to its presently preferred embodiment, it is not limited thereto. Rather, the invention is limited only insofar as it is defined by the following set of patent claims and includes within its scope all equivalents thereof.

The invention claimed is:

1. A clamp device comprising:

a clamp frame configured and dimensioned to removably receive an object;

a slide shaft having a longitudinal dimension that cooperates with said clamp frame to removably secure together portions of the object, said slide shaft being disposed such that a user is capable of urging said slide shaft toward said clamp frame via a thumb portion of the user's hand while at least one finger of the same hand supports said clamp frame;

a biasing member disposed upon said slide shaft, said biasing member having a first end that engages an outer first end portion of said clamp frame;

a binding member having a first portion that slidably engages said slide shaft, said binding member includes a plurality of binding plates;

a retaining member retractably secured to said outer first end portion of said clamp frame, said retaining member engaging a second portion of said binding member; and a first engagement member secured to a first end of said slide shaft, and a second engagement member secured to an inner second end portion of said clamp frame, whereby said slide shaft and said first engagement member secured thereto are urged toward said second engagement member until securing the object between said first and second engagement members, whereupon, said retaining member is inserted into said clamp frame thereby urging said retaining member, binding member and biasing member to cooperate to move the position of said slide shaft relative to said clamp frame to facilitate forceful engagement between said first engagement member and a first portion of the object, and to facilitate forceful engagement between said second engagement member and a second portion of the object.

2. The clamp of claim 1 wherein said clamp frame includes a substantially "C" configuration.

3. The clamp of claim 1 wherein said clamp frame includes a plurality of apertures for reducing the weight of said clamp frame.

4. The clamp of claim 1 wherein said slide shaft includes a second end having means for manually disposing said slide shaft relative to said clamp frame.

5. The clamp of claim 1 wherein said biasing member includes a spring slidably and annular disposed about said slide shaft.

6. The clamp of claim 1 wherein said binding member includes at least one binding plate.

7. The clamp of claim 1 wherein said first portion of said binding member includes an aperture that slidably receives said slide shaft.

8. The clamp of claim 1 wherein said second portion of said binding member includes a recess that removably receives a threaded first end portion of said retaining member.

9. The clamp of claim 1 wherein said retaining member includes a knurled second end portion for promoting manual rotary motion upon said retaining member.

10. The clamp of claim 1 wherein said first and second engagement members include pads for engaging portions of the object, and pad swivels and O rings for promoting pivotal movement of said pads upon said pad swivels, said pad swivels and O rings cooperating to snugly secure said pads to said pad swivels thereby retaining selected pad positions after said pads are moved by a user or by the object.

11. The clamp of claim 10 wherein said pads include a cavity having a recess portion and an edge portion, said recess portion including a diameter relatively larger than the diameter of a first portion of said pad swivels, said recess portion diameter being relatively smaller than an outer diameter of said O ring, said edge portion including an inner diameter relatively smaller than said recess portion diameter.

12. The clamp of claim 11 wherein said pad swivels include a second portion having a diameter relatively smaller than the diameter of said first portion, and a third portion having a diameter relatively larger than the diameter of said second portion, said first, second and third portion diameters cooperating to dispose and secure said O ring upon said second portion via forcibly inserting said first portion through an aperture of said O ring until an inner portion of said O ring engages said second portion of said pad swivel, said inner portion of said O ring including an inner diameter relatively smaller than said second portion diameter of said pad swivel.

13. The clamp of claim 12 wherein said O ring is configured and sized to promote pivotal movement between said pads and said pad swivels.

14. The clamp of claim 13 wherein said O ring is configured and sized to provide sufficient rigidity to said swivels whereby said pads maintain a selected position after being moved to said selected position by a person operating said clamp or by the object.

15. The clamp of claim 10 wherein said first and second engagement members include interchangeable pads of varying dimensions to promote the adaptation of said clamp device for objects varying in size and configuration.

16. A clamp comprising:

a clamp frame;

a slide shaft having a longitudinal dimension that cooperates with said clamp frame to removably secure an object to said clamp, said slide shaft being disposed such that a user is able to urge said slide shaft toward said clamp frame while the user supports said clamp frame;

a biasing member adjacently disposed to said slide shaft, said biasing member having a first end that engages an outer first end portion of said clamp frame;

a binding member having a first portion that slidably engages said slide shaft, said binding member includes a plurality of binding plates;

a retaining member disposed to engage a second portion of said binding member, said retaining member ultimately being urged into an aperture in said clamp frame, said aperture being disposed adjacent to said slide shaft; and a first engagement member secured to a first end of said slide shaft, and a second engagement member secured to an inner second end portion of said clamp frame, said first and second engagement members ultimately securing an object therebetween when said retaining member, said binding member and said biasing member cooperate to allow said slide shaft to be manually urged toward the object, said retaining member, said binding member and said biasing member cooperating to maintain the position of said slide shaft after the manually urging is removed from said slide shaft, thereby maintaining the object between said first and second enganement members, whereupon, said retaining member may be further urged into said aperture to increase the grasping force of the first and second engagement members upon the object, said binding member ultimately being manually moved to a position that allows said slide shaft to be manually disposed such that said first engagement member is separated from the object.

17. The clamp of claim 16 wherein said biasing member includes a spring slidably disposed about said slide shaft.

18. The clamp of claim 16 wherein said first and second engagement members include pads for engaging predetermined portions of the object, and pad swivels and O rings for promoting pivoting movement of said pads upon said pad swivels, said pad swivels and O rings cooperating to snugly secure said pads to said pad swivels thereby retaining selected pad positions after said pads are moved by a person or by the object.

19. The clamp of claim 16 wherein said binding plates include eccentric configurations for maintaining the position of said slide shaft after manually disposing said slide shaft such that said first and second engagement members forcefully engage portions of the object.

20. A method for clamping together portions of a workpiece, said method comprising the steps of:

providing a substantially C configured clamp frame;

providing a slide shaft dimensioned to cooperate with said clamp frame to secure together portions of a workpiece;

disposing an engagement member upon an engagement portion of said clamp frame and disposing an engagement member upon an end of said shaft;

sliding said slide shaft to urge said engagement members into engagement with portions of the workpiece;

binding said slide shaft, via a plurality of binding plates, after said engagement members engage the portions of the workpiece;

moving said slide shaft, via a retaining member, to increase the securing force imparted by said engagement members upon the workpiece; and maintaining said securing force imparted by said engagement members upon the portions of the workpiece until moving a binding member or said retaining member to release said slide shaft, whereupon, said engagement members are separated from the portions of the workpiece.

* * * * *